US012760398B2

(12) United States Patent
Tomita et al.

(10) Patent No.: US 12,760,398 B2
(45) Date of Patent: Oct. 13, 2026

(54) ALUMINUM ALLOY INGOT, ALUMINUM ALLOY MATERIAL AND METHOD FOR MANUFACTURING ALUMINUM ALLOY MATERIAL

(71) Applicant: Resonac Corporation, Tokyo (JP)

(72) Inventors: Yuto Tomita, Tokyo (JP); Yoshifumi Kimura, Tokyo (JP)

(73) Assignee: Resonac Corporation, Tokyo (JP)

( * ) Notice: Subject to any disclaimer, the term of this patent is extended or adjusted under 35 U.S.C. 154(b) by 341 days.

(21) Appl. No.: 18/709,338

(22) PCT Filed: Aug. 24, 2022

(86) PCT No.: PCT/JP2022/031810
§ 371 (c)(1),
(2) Date: May 10, 2024

(87) PCT Pub. No.: WO2023/084864
PCT Pub. Date: May 19, 2023

(65) Prior Publication Data

US 2025/0034689 A1 Jan. 30, 2025

(30) Foreign Application Priority Data

Nov. 15, 2021 (JP) ..... 2021-185963

(51) Int. Cl.

| | |
|---|---|
| ***C22F 1/047*** | (2006.01) |
| ***B22D 11/00*** | (2006.01) |
| ***B22D 11/045*** | (2006.01) |
| ***C22C 21/02*** | (2006.01) |

(52) U.S. Cl.
CPC ..... *C22F 1/047* (2013.01); *B22D 11/003* (2013.01); *B22D 11/045* (2013.01); *C22C 21/02* (2013.01)

(58) Field of Classification Search
CPC ..... C22F 1/047; B22D 11/003; C22C 21/02
See application file for complete search history.

(56) References Cited

FOREIGN PATENT DOCUMENTS

| | | | |
|---|---|---|---|
| JP | 7-258784 | A | 10/1995 |
| JP | 2007-169740 | A | 7/2007 |
| JP | 2008-163445 | A | 7/2008 |
| JP | 2021-143369 | A | 9/2021 |
| JP | 2021-143370 | A | 9/2021 |
| JP | 2021-143371 | A | 9/2021 |
| JP | 2021-143372 | A | 9/2021 |
| JP | 2023-073118 | A | 5/2023 |
| WO | 2011/046196 | A1 | 4/2011 |

*Primary Examiner* — Alexandra M Moore
(74) *Attorney, Agent, or Firm* — Sughrue Mion, PLLC

(57) ABSTRACT

Aluminum alloy ingot containing Cu: 0.3 to 1.0 mass %, Mg: 0.6 to 1.2 mass %, Si: 0.9 to 1.4 mass %, Mn: 0.4 to 0.6 mass %, Fe: 0.1 to 0.7 mass %, Cr: 0.09 to 0.25 mass %, and Ti: 0.012 to 0.035 mass %, and in an X-ray diffraction pattern measured using Cu-Kα rays, a peak height of a diffraction peak at a diffraction angle 2θ of 41.6 to 42.0° is a value smaller than 6 times a standard deviation of a background X-ray intensity in a range of a full width at half maximum of the diffraction peak, and in a heat-treated product after heating at 450° C. for 1 hour, a peak height of the diffraction peak at a diffraction angle 2θ of 41.6 to 42.0° is 15 times or more a standard deviation of the background X-ray intensity in the range of a full width at half maximum of the diffraction peak.

14 Claims, 4 Drawing Sheets

ALUMINUM ALLOY INGOT, ALUMINUM ALLOY MATERIAL AND METHOD FOR MANUFACTURING ALUMINUM ALLOY MATERIAL

CROSS REFERENCE TO RELATED APPLICATIONS

This application is a National Stage of International Application No. PCT/JP2022/031810 filed Aug. 24, 2022, claiming priority based on Japanese Patent Application No. 2021-185963 filed Nov. 15, 2021.

TECHNICAL FIELD

The present invention relates to an aluminum alloy ingot, an aluminum alloy material and a method for manufacturing an aluminum alloy material.

BACKGROUND ART

In order to obtain a high-quality metal product, it is important to form a metal structure according to properties of a desired product. The base of the metal structure of a metal product manufactured through a casting step is generally formed in the casting step when the molten metal (liquid phase) is cooled and coagulated into a solid (solid phase). That is, in controlling the quality of the metal product, the form of the metal structure of the ingot obtained in the stage of the casting step is very important.

The metal structure formed in the aluminum alloy casting step generally has a composition containing branched crystals in which an aluminum phase grows into branches (dendrites) and compound particles that precipitate through the gaps between the branched crystals. As the compound particles, particles of compounds containing metal elements derived from additive elements and Al are known. In addition, it is known that properties of the aluminum alloy material may vary depending on the compound particles. For example, for 6000 series aluminum alloys, which are Al—Mg—Si alloys, it has been examined that the press formability and bending processability be improved by controlling the average number density and size distribution of Mg—Si-based compound particles and single Si particles (Patent Document 1).

CITATION LIST

Patent Document

[Patent Document 1]
Japanese Unexamined Patent Application, First Publication No. 2007-169740

SUMMARY OF INVENTION

Technical Problem

An object of the present invention is to provide an aluminum alloy ingot that can be advantageously used as a raw material for aluminum alloy materials (products) with improved tensile strength. In addition, an object of the present invention is to provide an aluminum alloy material with improved tensile strength and a method for manufacturing the same.

Solution to Problem

In order to achieve the above objects, the present invention provides the following aspects.

(1) An aluminum alloy ingot including a Cu content in a range of 0.3 mass % or more and 1.0 mass % or less, a Mg content in a range of 0.6 mass % or more and 1.2 mass % or less, a Si content in a range of 0.9 mass % or more and 1.4 mass % or less, a Mn content in a range of 0.4 mass % or more and 0.6 mass % or less, an Fe content in a range of 0.1 mass % or more and 0.7 mass % or less, a Cr content in a range of 0.09 mass % or more and 0.25 mass % or less, and a Ti content in a range of 0.012 mass % or more and 0.035 mass % or less, with the remainder being made up of Al and unavoidable impurities, wherein, in an X-ray diffraction pattern measured using Cu-Kα rays, a peak height of a diffraction peak observed in a diffraction angle 2θ range of 41.6° or more and 42.0° or less is a value smaller than 6 times a standard deviation of a background X-ray intensity in a range of a full width at half maximum of the diffraction peak, and wherein, in a heat-treated product after heating at 450° C. for 1 hour, in an X-ray diffraction pattern measured using Cu-Kα rays, a peak height of the diffraction peak observed in a diffraction angle 2θ range of 41.6° or more and 42.0° or less is 15 times or more a standard deviation of the background X-ray intensity in the range of a full width at half maximum of the diffraction peak.

(2) The aluminum alloy ingot according to (1), wherein, in an X-ray diffraction pattern measured using Cu-Kα rays, a peak height of a diffraction peak observed in a diffraction angle 2θ range of 43.0° or more and 43.4° or less is a value smaller than 6 times the standard deviation of the background X-ray intensity in the range of a full width at half maximum of the diffraction peak, and wherein, in a heat-treated product after heating at 450° C. for 1 hour, in an X-ray diffraction pattern measured using Cu-Kα rays, a peak height of the diffraction peak observed in a diffraction angle 2θ range of 41.6° or more and 42.0° or less is 20 times or more the standard deviation of the background X-ray intensity in the range of the full width at half maximum of the diffraction peak.

(3) The aluminum alloy ingot according to (1) or (2), further including a B content in a range of 0.001 mass % or more and 0.03 mass % or less.

(4) An aluminum alloy material including a Cu content in a range of 0.3 mass % or more and 1.0 mass % or less, a Mg content in a range of 0.6 mass % or more and 1.2 mass % or less, a Si content in a range of 0.9 mass % or more and 1.4 mass % or less, a Mn content in a range of 0.4 mass % or more and 0.6 mass % or less, an Fe content in a range of 0.1 mass % or more and 0.7 mass % or less, a Cr content in a range of 0.09 mass % or more and 0.25 mass % or less, and a Ti content in a range of 0.012 mass % or more and 0.035 mass % or less, with the remainder being made up of Al and unavoidable impurities, wherein, in an X-ray diffraction pattern measured using Cu-Kα rays, a peak height of a diffraction peak observed in a diffraction angle 2θ range of 41.6° or more and 42.0° or less is 15 times or more a standard deviation of a background X-ray intensity in a range of a full width at half maximum of the diffraction peak, and a ratio of the peak height to the full width at half maximum of the diffraction peak is 5,500 or more.

(5) The aluminum alloy material according to (4), wherein, in an X-ray diffraction pattern measured using Cu-Kα rays, a peak height of a diffraction peak observed in a diffraction angle 2θ range of 41.6° or more and 42.0° or less is 20 times or more a standard deviation of a background X-ray intensity in a range of a full width at half maximum of the diffraction peak, and a ratio of the peak height to the full width at half maximum of the diffraction peak is 5,500 or more.

(6) A method for manufacturing the aluminum alloy material according to (4) or (5), including a step of heating the aluminum alloy ingot according to any one of (1) to (3) at 400° C. or higher for 1 hour or longer.

Advantageous Effects of Invention

According to the present invention, it is possible to provide an aluminum alloy ingot that can be advantageously used as a raw material for aluminum alloy materials (products) with improved tensile strength. In addition, according to the present invention, it is possible to provide an aluminum alloy material with improved tensile strength and a method for manufacturing the same.

DESCRIPTION OF EMBODIMENTS

Figure 1:
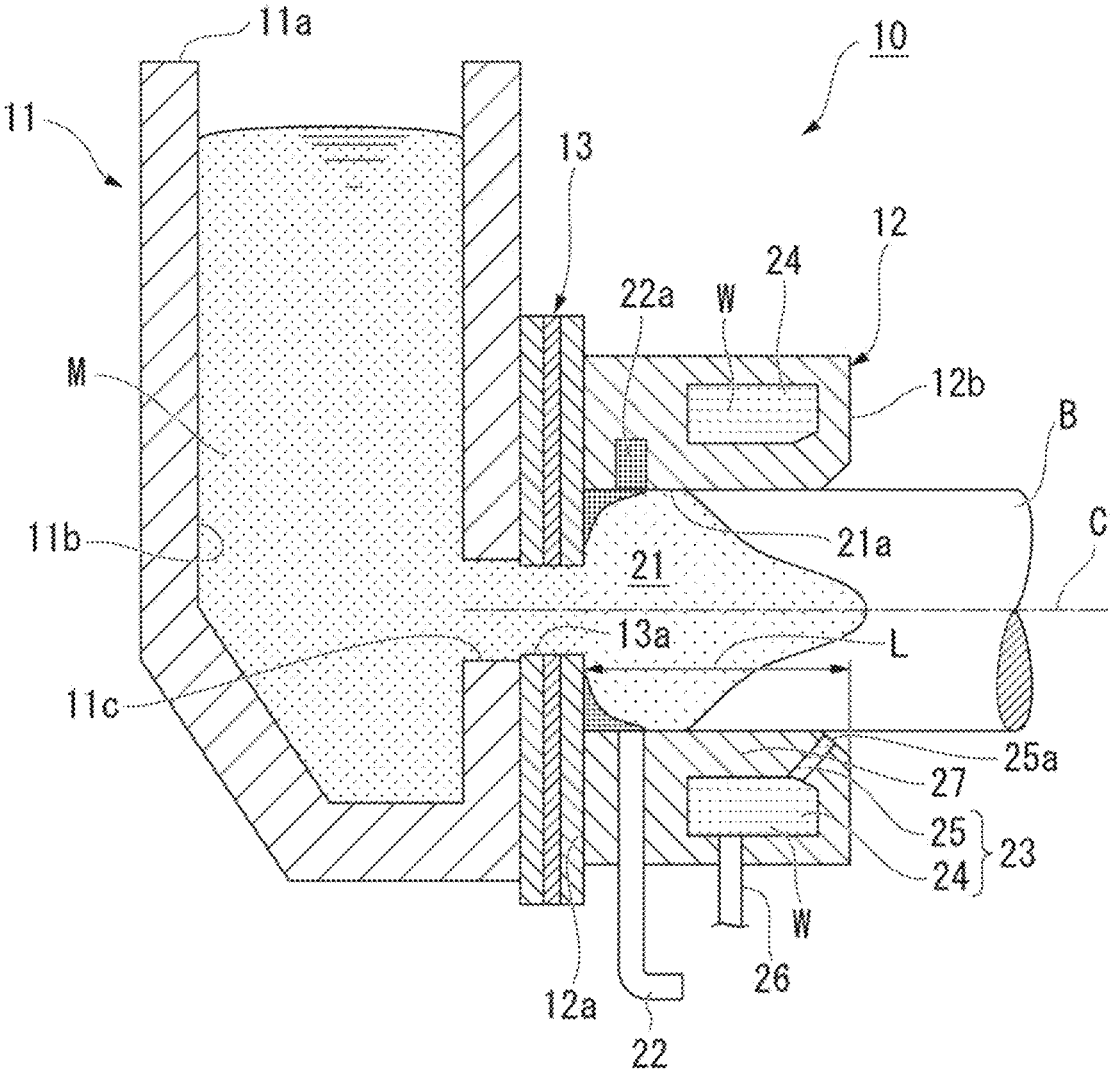
FIG. 1 is a cross-sectional view showing an example of the vicinity of a mold of a horizontal continuous casting apparatus for manufacturing an aluminum alloy ingot according to an embodiment of the present invention.

Hereinafter, an aluminum alloy ingot, a method for manufacturing an aluminum alloy ingot, an aluminum alloy material and a method for manufacturing an aluminum alloy material according to embodiments of the present invention will be described with reference to the drawings. Here, the embodiments shown below are described in detail for better understanding of the spirit of the invention, and do no limit the present invention unless otherwise specified. In addition, in the drawings used in the following description, in order to facilitate understanding of features of the present invention, main parts are enlarged for convenience of illustration in some cases, and dimensional ratios of components are not necessarily the same as actual ones.

[Aluminum Alloy Ingot]

The aluminum alloy ingot of the present embodiment includes a Cu content in a range of 0.3 mass % or more and 1.0 mass % or less, a Mg content in a range of 0.6 mass % or more and 1.2 mass % or less, a Si content in a range of 0.9 mass % or more and 1.4 mass % or less, a Mn content in a range of 0.4 mass % or more and 0.6 mass % or less, an Fe content in a range of 0.1 mass % or more and 0.7 mass % or less, a Cr content in a range of 0.09 mass % or more and 0.25 mass % or less, and a Ti content in a range of 0.012 mass % or more and 0.035 mass % or less, with the remainder being made up of Al and unavoidable impurities. Here, in addition to the above components, the aluminum alloy ingot may further have a B content in a range of 0.001 mass % or more and 0.03 mass % or less. The aluminum alloy ingot of the present embodiment corresponds to a 6000 series aluminum alloy ingot in that it contains Mg and Si.

(Cu: 0.3 Mass % or More and 1.0 Mass % or Less)

Cu has a function of finely dispersing a Mg—Si-based compound in the aluminum alloy and has a function of improving the tensile strength of the aluminum alloy by precipitating as an Al—Cu—Mg—Si-based compound including a Q phase. When the Cu content is within the above range, it is possible to improve the tensile strength of the aluminum alloy.

(Mg: 0.6 Mass % or More and 1.2 Mass % or Less)

Mg has a function of improving the tensile strength of the aluminum alloy. When Mg is solid-solutionized in an aluminum base phase or precipitates as a Mg—Si-based compound such as a β" phase or an Al—Cu—Mg—Si-based compound including a Q phase, it contributes to strengthening of the aluminum alloy. When the Mg content is within the above range, it is possible to improve the tensile strength of the aluminum alloy.

(Si: 0.9 Mass % or More and 1.4 Mass % or Less)

Si has a function of improving the tensile strength of the aluminum alloy. However, when excessive Si is added to the aluminum alloy, there is a risk of coarse primary crystal Si grains crystallizing and the tensile strength of the aluminum alloy decreasing. When the Si content is within the above range, it is possible to improve the tensile strength of the aluminum alloy while minimizing crystallization of primary crystal Si.

(Mn: 0.4 Mass % or More and 0.6 Mass % or Less)

Mn has a function of improving the tensile strength of the aluminum alloy by forming fine granular crystals containing intermetallic compounds such as Al—Mn—Fe—Si and Al—Mn—Cr—Fe—Si in the aluminum alloy. When the Mn content is within the above range, it is possible to improve the tensile strength of the aluminum alloy.

(Fe: 0.1 Mass % or More and 0.7 Mass % or Less)

Fe has a function of improving the tensile strength of the aluminum alloy by crystallizing as fine crystals containing intermetallic compounds such as Al—Mn—Fe—Si, Al—Mn—Cr—Fe—Si, Al—Fe—Si, Al—Cu—Fe, and Al—Mn—Fe in the aluminum alloy. When the Fe content is within the above range, it is possible to improve the tensile strength of the aluminum alloy.

(Cr: 0.09 Mass % or More and 0.25 Mass % or Less)

Cr has a function of improving the tensile strength of the aluminum alloy by forming fine granular crystals containing intermetallic compounds such as Al—Mn—Cr—Fe—Si and Al—Fe—Cr in the aluminum alloy. When the Cr content is within the above range, it is possible to improve the tensile strength of the aluminum alloy.

(Ti: 0.012 Mass % or More and 0.035 Mass % or Less)

Ti has a function of refining aluminum alloy ingot crystal grains and improving stretching processability. When the Ti content is less than 0.012 mass %, there is a risk of a sufficient crystal grain refining effect being not obtained. On the other hand, when the Ti content is more than 0.035 mass %, there is a risk of coarse crystals being formed and stretching processability deteriorating. In addition, when a large amount of coarse crystals containing Ti are mixed into the final aluminum alloy product, the toughness may decrease. Therefore, the Ti content is in a range of 0.012 mass % or more and 0.035 mass % or less. The Ti content is preferably in a range of 0.015 mass % or more and 0.030 mass % or less.

(B: 0.001 Mass % or More and 0.03 Mass % or Less)

B has a function of refining aluminum alloy ingot crystal grains and improving stretching processability. When B is additionally added to the aluminum alloy together with the above Ti, the crystal grain refining effect is improved. When the B content is less than 0.001 mass %, there is a risk of a sufficient crystal grain refining effect being not obtained. On the other hand, when the B content is more than 0.03 mass %, there is a risk of coarse crystals being formed and mixed into the final aluminum alloy product as inclusions. In addition, when a large amount of coarse crystals containing B are mixed into the final aluminum alloy product, the toughness may decrease. Therefore, the B content is in a range of 0.001 mass % or more and 0.03 mass % or less. The B content is preferably in a range of 0.005 mass % or more and 0.025 mass % or less.

(Unavoidable Impurities)

Unavoidable impurities are impurities that are unavoidable mixed into the aluminum alloy from an aluminum alloy raw material or in the manufacturing step. Examples of unavoidable impurities include Zn, Ni, Zr, Sn, and Be. It is preferable that the content of these unavoidable impurities be not more than 0.1 mass %.

In the aluminum alloy ingot of the present embodiment, in the X-ray diffraction pattern measured using Cu-Kα rays, a peak height of a diffraction peak (peak α1) observed in a diffraction angle 2θ range of 41.6° or more and 42.0° or less is a value smaller than 6 times the standard deviation $\sigma_{bkg}$ of the background X-ray intensity in a range of the full width at half maximum of the diffraction peak. That is, the ratio (peak height/$\sigma_{bkg}$) of the peak height of the peak α1 to the standard deviation $\sigma_{bkg}$ of the background X-ray intensity in a range of the full width at half maximum of the peak α1 is less than 6. Here, a case in which the peak height of the peak α1/Obke is less than 6 includes a case in which the peak α1 is not detected.

The peak height of the diffraction peak is a value obtained by subtracting the background X-ray intensity of the diffraction peak from the X-ray intensity (unit: cps) of the diffraction peak measured using an X-ray diffraction device. The peak height of the diffraction peak can be determined, for example, by fitting a split pseudo-Voigt function to the range of the full width at half maximum of the diffraction peak. In addition, the standard deviation $\sigma_{bkg}$ of the background X-ray intensity can be determined by, for example, obtaining a background curve obtained by fitting a spline curve to the entire profile of the X-ray diffraction peak and calculating a standard deviation of intensities in a range of the full width at half maximum of the diffraction peak of the obtained background curve. The peak height of the diffraction peak and the standard deviation $\sigma_{bkg}$ of the background X-ray intensity can be calculated using, for example, commercially available analysis software (PDXL II, commercially available from Rigaku Corporation).

The peak α1 is a diffraction peak corresponding to an interplanar spacing of 2.154 Å in α-$Al_{15}$(Fe, Mn, (Cr))$_3Si_2$. α-$Al_{15}$(Fe, Mn, (Cr))$_3Si_2$ is a type of intermetallic compound represented by Al—Mn—Fe—Si and Al—Mn—Cr—Fe—Si. Here, if there are a plurality of diffraction peaks in a diffraction angle 2θ range of 41.6° or more and 42.0° or less, the peak with the highest peak height is used.

The peak height of the peak α1/$\sigma_{bkg}$ indicates the content of α-$Al_{15}$(Fe, Mn, (Cr))$_3Si_2$ in the metal structure of the aluminum alloy ingot. The peak height of the peak α1/$\sigma_{bkg}$ is more preferably less than 1.

In addition, in the aluminum alloy ingot of the present embodiment, in the X-ray diffraction pattern measured using Cu-Kα rays, the peak height of the diffraction peak (peak α2) observed in a diffraction angle 2θ range of 43.0° or more and 43.4° or less may be a value smaller than 6 times the standard deviation of the background X-ray intensity in a range of the full width at half maximum of the diffraction peak. That is, the ratio (peak height/$\sigma_{bkg}$) of the peak height of the peak α2 to the standard deviation $\sigma_{bkg}$ of the background X-ray intensity in a range of the full width at half maximum of the peak α2 is less than 6. Here, a case in which the peak height of the peak α2/$\sigma_{bkg}$ is less than 6 includes a case in which the peak α2 is not detected.

The peak α2 is a diffraction peak corresponding to an interplanar spacing of 2.093 Å in α-$Al_{15}$(Fe, Mn, (Cr))$_3Si_2$. Here, if there are a plurality of diffraction peaks in a diffraction angle 2θ range of 43.0° or more and 43.4° or less, the peak with the highest peak height is used. The peak height of the peak α2/$\sigma_{bkg}$ is more preferably less than 1.

In the aluminum alloy ingot of the present embodiment, in the X-ray diffraction pattern measured using Cu-Kα rays for the heat-treated product after a heat treatment at 450° C. for 1 hour, the peak height of the diffraction peak (peak α1) observed in a diffraction angle 2θ range of 41.6° or more and 42.0° or less is 15 times or more the standard deviation of the background X-ray intensity in a range of the full width at half maximum of the diffraction peak. That is, according to the heat treatment, the peak height of the peak α1/$\sigma_{bkg}$ increases. This means that the content of α-$Al_{15}$(Fe, Mn, (Cr))$_3Si_2$ in the metal structure of the aluminum alloy increases according to the heat treatment. When the content of α-$Al_{15}$(Fe, Mn, (Cr))$_3Si_2$ in the metal structure increases, the heat-treated product has higher tensile strength than the aluminum alloy ingot. The peak height of the peak α1/$\sigma_{bkg}$ of the heat-treated product is preferably 100 or less.

In the X-ray diffraction pattern measured using Cu-Kα rays for the heat-treated product, the height of the diffraction peak (peak α2) observed in a diffraction angle 2θ range of 43.0° or more and 43.4° or less, and the peak height of the diffraction peak (peak β) observed in a diffraction angle 2θ range of 38.4° or more and 38.8° or less may be 20 times or more the standard deviation of the background X-ray intensity in a range of the full width at half maximum of the diffraction peak. The peak height of the peak α2/$\sigma_{bkg}$ of the heat-treated product is preferably in a range of 40 or more and 100 or less.

[Method for Manufacturing Aluminum Alloy Ingot]

Next, a method for manufacturing an aluminum alloy ingot of the present embodiment will be described.

The aluminum alloy ingot of the present embodiment can be manufactured by, for example, a method including a molten metal forming step and a casting step.

(Molten Metal Forming Step)

In the molten metal forming step, an aluminum alloy molten metal is formed. The composition of the aluminum alloy molten metal is the same as the composition of the aluminum alloy ingot. The aluminum alloy molten metal can be obtained by heating and melting an aluminum alloy. In addition, it may be formed by melting a mixture containing a single element or a compound containing two or more elements, which is a raw material for an aluminum alloy, in a proportion at which a desired aluminum alloy is produced. For example, in order to control the crystal grain size of the aluminum alloy produced in the casting step, Ti or B may be mixed in as a crystal grain refining material such as in an Al—Ti—B rod.

(Casting Step)

In the casting step, an aluminum alloy molten metal (liquid phase) is cooled and coagulated into a solid (solid phase) to obtain an aluminum alloy ingot. In the casting step, for example, a horizontal continuous casting method can be used. FIG. 1 is a cross-sectional view showing an example of a horizontal continuous casting apparatus that can be used to manufacture an aluminum alloy ingot of the present embodiment, and FIG. 2 is an enlarged cross-sectional view of main parts showing the vicinity of a cooling water cavity of the horizontal continuous casting apparatus shown in FIG. 1.

Figure 2:
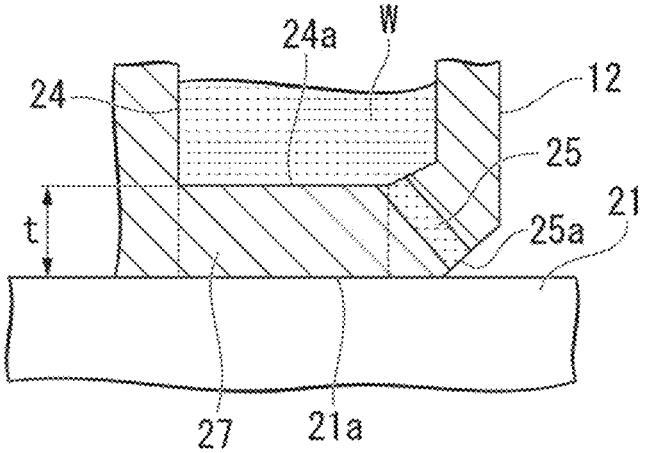
FIG. 2 is an enlarged cross-sectional view of main parts showing the vicinity of a cooling water cavity in FIG. 1.

A horizontal continuous casting apparatus 10 shown in FIG. 1 and FIG. 2 includes a molten metal receiving part (tundish) 11, a hollow cylindrical mold 12, and a refractory plate (insulation member) 13 disposed between one end side 12*a* of the mold 12 and the molten metal receiving part 11.

The molten metal receiving part 11 is composed of a molten metal inflow part 11*a* that receives the aluminum alloy molten metal M obtained in the above molten metal forming step, a molten metal holding part 11*b*, and an outflow part 11*c* toward a hollow part 21 of the mold 12. The molten metal receiving part 11 maintains the level of the upper liquid surface of the aluminum alloy molten metal M at a position higher than the upper surface of the hollow part 21 of the mold 12, and in the case of continuous casting, stably distributes the aluminum alloy molten metal M to each mold 12.

The aluminum alloy molten metal M held in the molten metal holding part 11*b* in the molten metal receiving part 11 is poured into the hollow part 21 of the mold 12 through a pouring path 13*a* provided at the refractory plate 13. Then, the aluminum alloy molten metal M supplied into the hollow part 21 is cooled and solidified by a cooling apparatus 23 to be described below, and is drawn out from the other end side 12*b* of the mold 12 as an aluminum alloy rod B which is a coagulated ingot.

A drawer drive device (not shown) that draws out the cast aluminum alloy rod B at a certain speed may be installed on the other end side 12*b* of the mold 12. In addition, it is preferable that a synchronous cutting machine (not shown) that cuts the continuous drawn aluminum alloy rod B to an arbitrary length be installed.

The refractory plate 13 is a member that blocks heat transfer between the molten metal receiving part 11 and the mold 12, and may be made of a material, for example, calcium silicate, alumina, silica, a mixture of alumina and silica, silicon nitride, silicon carbide, graphite or the like. Such a refractory plate 13 can also be composed of a plurality of layers made of different constituent materials.

The mold 12 is a hollow cylindrical member in the present embodiment, and is, for example, formed of one material selected from among aluminum, copper, and alloys thereof or a combination of two or more thereof. For such a material of the mold 12, an optimal combination may be selected in consideration of thermal conductivity, heat resistance, and mechanical strength.

The hollow part 21 of the mold 12 is formed to have a circular cross section in order to make the aluminum alloy rod B to be cast into a cylindrical rod shape, and the mold 12 is held such that the mold central axis (central axis) C passing through the center of the hollow part 21 is substantially in the horizontal direction.

An inner circumferential surface 21*a* of the hollow part 21 of the mold 12 is formed at an elevation angle of 0 degrees or more and 3 degrees or less (more preferably 0 degrees or more and 1 degree or less) with respect to the mold central axis C in the casting direction (refer to FIG. 5) of the aluminum alloy rod B. That is, the inner circumferential surface 21*a* has a tapered structure that opens into a cone shape in the casting direction. Thus, the angle formed by the taper is the elevation angle.

When the elevation angle is less than 0 degrees, there is a risk of casting becoming difficult because resistance is applied on the other end side 12*b*, which is the mold outlet, when the aluminum alloy rod B is drawn out from the mold 12. On the other hand, when the elevation angle is more than 3 degrees, there is a risk of the degree of contact of the inner circumferential surface 21*a* with the aluminum alloy molten metal M becoming insufficient, the effect of removing heat from the aluminum alloy molten metal M and the coagulated shell obtained by cooling and solidifying it to the mold 12, and thus coagulation becoming insufficient. As a result, this is not preferable because there is a risk of a re-melted surface occurring on the surface of the aluminum alloy rod B, or casting troubles such as spraying of the uncoagulated aluminum alloy molten metal M from the end of the aluminum alloy rod B.

Here, in addition to the circular shape in the present embodiment, the cross-sectional shape (the planar shape when the hollow part 21 of the mold 12 is viewed from the other end side) of the hollow part 21 of the mold 12 may be selected from among, for example, a triangular or rectangular cross-sectional shape, a polygonal shape, a semicircular shape, an elliptical shape, and an irregular cross-sectional shape having no symmetric axis or symmetric surface, according to the shape of the aluminum alloy rod to be cast.

On the one end side 12*a* of the mold 12, a fluid supply pipe 22 through which a lubricating fluid is supplied into the hollow part 21 of the mold 12 is arranged. As the lubricating fluid supplied from the fluid supply pipe 22, any one or more lubricating fluids selected from among gas lubricants and liquid lubricants can be used. When both a gas lubricant and a liquid lubricant are supplied, it is preferable to provide respective fluid supply pipes separately. The lubricating fluid supplied under pressure from the fluid supply pipe 22 is supplied into the hollow part 21 of the mold 12 through an annular lubricant supply port 22*a*.

In the present embodiment, the pressure-fed lubricating fluid is supplied from the lubricant supply port 22*a* to the inner circumferential surface 21*a* of the mold 12. Here, the liquid lubricant may be heated to become a decomposed gas and supplied to the inner circumferential surface 21*a* of the mold 12. In addition, a porous material may be disposed in the lubricant supply port 22*a* and the lubricating fluid may be exuded to the inner circumferential surface 21*a* of the mold 12 through the porous material. Inside the mold 12, the cooling apparatus 23 which is a cooling unit configured to cool and solidify the alloy molten metal M is formed. The cooling apparatus 23 of the present embodiment includes a cooling water cavity 24 that accommodates cooling water W for cooling the inner circumferential surface 21*a* of the hollow part 21 of the mold 12, and a cooling water injection path 25 that communicates between the cooling water cavity 24 and the hollow part 21 of the mold 12.

The cooling water cavity 24 is formed in an annular shape so that it surrounds the hollow part 21 outside the inner circumferential surface 21*a* of the hollow part 21 inside the mold 12, and the cooling water W is supplied through a cooling water supply pipe 26.

In the mold 12, the inner circumferential surface 21*a* is cooled with the cooling water W accommodated in the cooling water cavity 24, heat of the alloy molten metal M filled into the hollow part 21 of the mold 12 is removed from the surface of the mold 12 that comes into contact with the inner circumferential surface 21*a*, and a coagulated shell is formed on the surface of the alloy molten metal M.

In addition, in the cooling water injection path 25, cooling water is directly applied toward the aluminum alloy rod B from a shower opening 25*a* facing the hollow part 21 on the other end side 12*b* of the mold 12, and the aluminum alloy rod B is cooled. The longitudinal cross-sectional shape of the cooling water injection path 25 may be, for example, a semicircular shape, a pear shape, or a horseshoe shape, in addition to the circular shape in the present embodiment.

Here, in the present embodiment, the cooling water W supplied through the cooling water supply pipe 26 is first accommodated in the cooling water cavity 24 and cools the inner circumferential surface 21*a* of the hollow part 21 of the mold 12, and additionally, the cooling water W in the cooling water cavity 24 is injected toward the aluminum alloy rod B through the cooling water injection path 25, but it can be supplied through cooling water supply pipes of respective separate systems.

The length from the position at which the extension line of the central axis of the shower opening 25*a* of the cooling water injection path 25 touches the surface of the cast aluminum alloy rod B to the contact surface between the mold 12 and the refractory plate 13 is referred to as an effective mold length L, and this effective mold length L is preferably, for example, 10 mm or more and 40 mm or less. When the effective mold length L is less than 10 mm, casting is not possible because a favorable film is not formed, and when the effective mold length L is more than 40 mm, this is not preferable because there is a risk that the effect of forced cooling becomes weak, coagulation by the mold wall becomes dominant, the contact resistance between the mold 12 and the alloy molten metal M or the aluminum alloy rod B becomes large, cracks occur on the casting surface, breakage occurs inside the mold, and thus casting becomes unstable.

It is preferable that operations of supply of cooling water to the cooling water cavity 24 and injection of cooling water from the shower opening 25*a* of the cooling water injection path 25 can be controlled by a control signal from a control device (not shown).

The cooling water cavity 24 is formed such that an inner bottom surface 24*a* near the hollow part 21 of the mold 12 is parallel to the inner circumferential surface 21*a* of the hollow part 21 of the mold 12. Parallel here means that the inner circumferential surface 21*a* of the hollow part 21 of the mold 12 is formed at an elevation angle of 0 degrees or more and 3 degrees or less with respect to the inner bottom surface 24*a* of the cooling water cavity 24, that is, the inner bottom surface 24*a* is tilted by more than 0 degrees and up to 3 degrees with respect to the inner circumferential surface 21*a*.

As shown in FIG. 2, a cooling wall part 27 of the mold 12, which is a part in which the inner bottom surface 24*a* of the cooling water cavity 24 and the inner circumferential surface 21*a* of the hollow part 21 of the mold 12 face each other, is formed such that the heat flux value per unit area from the alloy molten metal M in the hollow part 21 toward the cooling water W in the cooling water cavity 24 is in a range of $10\times10^5$ W/m$^2$ or more and $50\times10^5$ W/m$^2$ or less.

The mold 12 may be formed such that the thickness t of the cooling wall part 27 of the mold 12, that is, the distance between the inner bottom surface 24*a* of the cooling water cavity 24 and the inner circumferential surface 21*a* of the hollow part 21 of the mold 12, is for example, in a range of 0.5 mm or more and 3.0 mm or less, and preferably 0.5 mm or more and 2.5 mm or less. In addition, the material for forming the mold 12 may be selected so that the thermal conductivity of at least the cooling wall part 27 of the mold 12 is in a range of 100 W/m·K or more and 400 W/m· K or less.

In FIG. 2, the alloy molten metal M in the molten metal receiving part 11 is supplied through the refractory plate 13 from the one end side 12*a* of the mold 12 that is held such that the mold central axis C is substantially horizontal, and forcedly cooled on the other end side 12*b* of the mold 12 to become the aluminum alloy rod B. Since the aluminum alloy rod B is drawn out at a certain speed by a drawer drive device (not shown) installed near the other end side 12*b* of the mold 12, the long aluminum alloy rod B is formed by continuous casting. The drawn aluminum alloy rod B is cut into a desired length by, for example, a synchronous cutting machine (not shown).

Here, the composition ratio of the cast aluminum alloy rod B can be confirmed, for example, by a method using an optical emission spectrometer (device example: PDA-5500, commercially available from Shimadzu Corporation, Japan) as described in JIS H 1305.

The difference between the height of the liquid level of the alloy molten metal M stored in the molten metal receiving part 11 and the height from the upper inner circumferential surface 21*a* of the mold 12 is preferably 0 mm or more and 250 mm or less (more preferably, 50 mm or more and 170 mm or less). Within this range, the pressure of the alloy molten metal M supplied into the mold 12 and lubricating oils and gases vaporized from the lubricating oil are appropriately balanced so that castability is stabilized.

As the liquid lubricant, vegetable oils, which are lubricating oils, can be used. Examples thereof include rapeseed oil, castor oil, and salad oil. These are preferable because they have less adverse impact on the environment.

The lubricating oil supply rate is preferably 0.05 mL/min or more and 5 mL/min or less (more preferably, 0.1 mL/min or more and 1 mL/min or less). When the supply rate is too low, there is a risk of the alloy molten metal of the aluminum alloy rod B not solidifying and leaking from the mold due to insufficient lubrication. When the supply rate is too high, there is a risk of an excess component being mixed into the aluminum alloy rod B and internal defects occurring.

The casting speed, which is a speed at which the aluminum alloy rod B is pulled out from the mold 12 is preferably 200 mm/min or more and 1,500 mm/min or less (more preferably, 400 mm/min or more and 1,000 mm/min or less). This is because, when the casting speed is within this range, the network structure of crystals formed by casting becomes uniform and fine, the resistance to deformation of the aluminum fabric at a high temperature increases, and the high-temperature mechanical strength is improved.

The amount of cooling water injected from the shower opening 25*a* of the cooling water injection path 25 is preferably 10 L/min or more and 50 L/min or less (more preferably, 25 L/min or more and 40 L/min or less) per mold. When the amount of cooling water is smaller than this range, there is a risk of the alloy molten metal not solidifying and leaking from the mold. In addition, there is a risk of the surface of the cast aluminum alloy rod B being re-melted, and a non-uniform structure that remains as an internal defect being formed. On the other hand, when the amount of cooling water is larger than this range, there is a risk of too much heat being removed from the mold 12 and coagulation occurring during progress.

The average temperature of the alloy molten metal M flowing into the mold 12 from the inside of the molten metal receiving part 11 is preferably, for example, 650° C. or higher and 750° C. or lower (more preferably, 680° C. or higher and 720° C. or lower). When the temperature of the alloy molten metal M is too low, there is a risk of coarse crystals being formed in the mold 12 and in front of it, and incorporated into the aluminum alloy rod B as internal defects. On the other hand, when the temperature of the alloy molten metal M is too high, there is a risk of a large amount of hydrogen gas being likely to be incorporated into the alloy molten metal M, and incorporated into the aluminum alloy rod B as pores, and creating an internal cavity.

Then, in the cooling wall part 27 of the mold 12, when the heat flux value per unit area from the alloy molten metal M in the hollow part 21 toward the cooling water W in the cooling water cavity 24 is in a range of $10\times10^5$ W/m$^2$ or more and $50\times10^5$ W/m$^2$ or less, it is possible to prevent the aluminum alloy rod B from burning.

Figure 3:
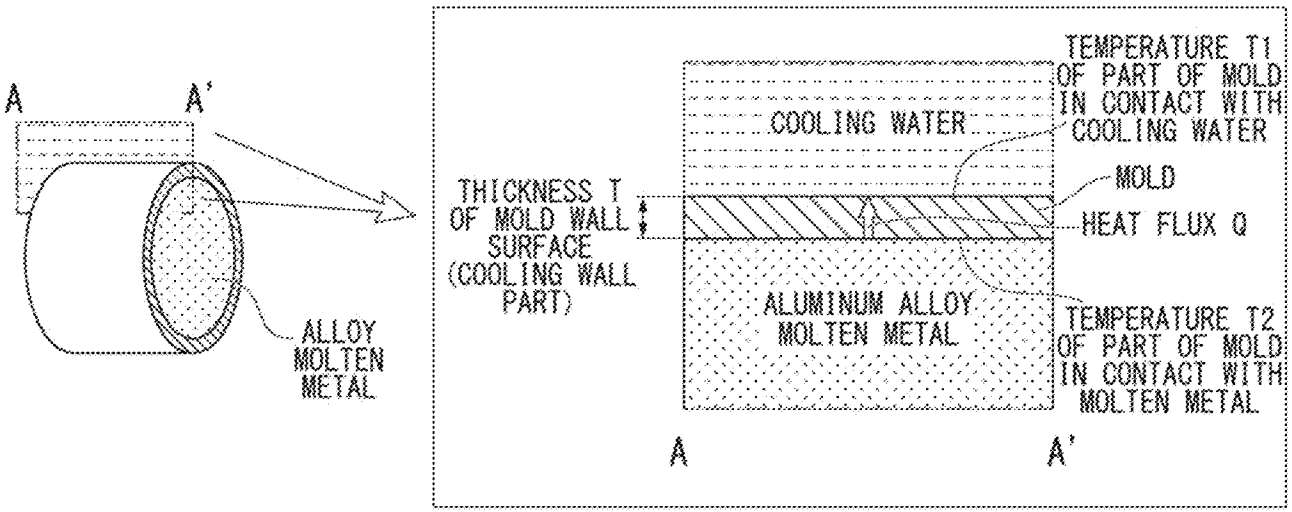
FIG. 3 is an illustrative diagram showing a heat flux of a cooling wall part of the horizontal continuous casting apparatus.

The cooling wall part 27 of the mold 12 receives heat due to heat removal from the alloy molten metal M, and performs heat exchange by cooling this heat with the cooling water W accommodated in the cooling water cavity 24, but regarding the state of this heat exchange, as shown in the illustrative diagram shown in FIG. 3, the heat flux per unit area has been focused on. The heat flux per unit area is represented by the following Formula (1) according to the Fourier's law.

$$Q=-k\times(T1-T2)/L \quad (1)$$

Q: heat flux k: thermal conductivity (W/m·K) of the part through which heat passes (the cooling wall part 27 of the mold 12 in the present embodiment)

T1: low-temperature side temperature of the part through which heat passes (the inner bottom surface 24*a* of the cooling water cavity 24 in the present embodiment)

T2: high-temperature side temperature of the part through which heat passes (the inner circumferential surface 21*a* of the hollow part 21 of the mold 12 in the present embodiment)

L: section length (mm) of the part through which heat passes (the thickness t of the cooling wall part 27 of the mold 12 in the present embodiment)

Based on the mold material, thickness, and temperature measurement data with which favorable results are obtained even if the amount of lubricating oil is reduced during casting, when the cooling wall part 27 of the mold 12 is formed such that the heat flux value per unit area is $10\times10^5$ W/m$^2$ or more, it is possible to prevent the cast aluminum alloy rod B from burning. In addition, the heat flux value per unit area is preferably $50\times10^5$ W/m$^2$ or less.

In order for the cooling wall part 27 of the mold 12 to have such a heat flux value range, the mold 12 may be formed such that the thickness t of the cooling wall part 27 of the mold 12 is, for example, in a range of 0.5 mm or more and 3.0 mm or less. In addition, the thermal conductivity of at least the cooling wall part 27 of the mold 12 may be in a range of 100 W/m·K or more and 400 W/m·K or less.

When the aluminum alloy rod of the present embodiment is manufactured, the alloy molten metal M stored in the molten metal receiving part 11 is continuously supplied from the one end side 12*a* of the mold 12 into the hollow part 21 using the above horizontal continuous casting apparatus 10. In addition, the cooling water W is supplied into the cooling water cavity 24 and a lubricating fluid, for example, lubricating oil, is also supplied from the fluid supply pipe 22.

Then, the alloy molten metal M supplied into the hollow part 21 is cooled and coagulated under conditions in which the heat flux value per unit area in the cooling wall part 27 is $10\times10^5$ W/m$^2$ or more, and the aluminum alloy rod B is cast. In addition, when the aluminum alloy rod B is cast, it is preferable that the wall surface temperature of the cooling wall part 27 of the mold 12 cooled with the cooling water W be set to be 100° C. or lower.

The aluminum alloy rod B obtained in this manner is cooled and coagulated under conditions in which the heat flux value per unit area in the cooling wall part 27 is $10\times10^5$ W/m$^2$ or more, and thus fixation of reaction products, for example, carbides, due to contact between the lubricating oil gas and the alloy molten metal M, is curbed. Thereby, there is no need to cut off and remove carbides and the like on the surface of the aluminum alloy rod B, and the aluminum alloy rod B can be manufactured with a high yield.

In the casting step for obtaining a cast product from an aluminum alloy molten metal, known continuous casting methods such as a vertical continuous casting method can be used without being limited to the above horizontal continuous casting method. Vertical continuous casting methods are classified into a float method and a hot top method depending on the method of supplying an aluminum alloy molten metal into a mold (mold), but a case using a hot top method will be briefly described below. The casting apparatus used in the hot top method includes a mold, a molten metal receiving container (header) and the like. The molten metal supplied to the molten metal receiving part passes through a tap outlet, the flow rate is adjusted when the molten metal passes through a header, and the molten metal enters a cylindrical mold that is installed substantially horizontally, and forcedly cooled therein, and a coagulated shell is formed on the outer surface of the molten metal. In addition, cooling water is directly released to the ingot drawn out from the mold, and the ingot is continuously drawn out while coagulation of the metal progresses to the inside of the ingot. Generally, the mold is made of a metal member with favorable thermal conductivity and has a hollow structure for introducing a refrigerant into the mold. The refrigerant used may be appropriately selected from among industrially available refrigerants, but water is recommended in consideration of ease of use. The material of the mold used in the present embodiment is appropriately selected from among metals such as copper and aluminum, and graphite in consideration of heat transfer performance and durability in a part in contact with the molten metal. The header is generally made of a refractory material, and is installed above the mold. The material and size of the header may be appropriately selected depending on the component ranges of the alloy to be cast and dimensions of the cast material, and there are no particular limitations.

The cooling rate of the aluminum alloy molten metal in the casting step is preferably set such that, for example, the minimum cooling rate on the entire cross section perpendicular to the casting direction is a rate of 50° C./sec or faster. In addition, the maximum cooling rate on the entire cross section perpendicular to the casting direction is preferably in a range of 100° C./sec or faster and 150° C./sec or slower in order to reduce the difference from the minimum cooling rate and reduce a variation in the cooling rate of the aluminum alloy molten metal. In addition, the difference between the minimum cooling rate and the maximum cooling rate is preferably, for example, 100° C./sec or slower. Here, the cooling rate on the entire cross section perpendicular to the casting direction may be measured by a method of actually measuring the temperature of the molten metal inside the header of the casting apparatus, but it can be more easily measured by observing the dendrite arm form in a cross section perpendicular to the casting direction of the obtained aluminum alloy ingot under an optical microscope and measuring the secondary dendrite arm spacing.

The casting speed may be, for example, in a range of 200 mm/min or more and 600 mm/min or less, in the case of, for example, a horizontal continuous casting method. According to the casting method described above, it is possible to obtain an aluminum alloy ingot having a uniform metal structure. The shape and size of the aluminum alloy ingot are not particularly limited, and for example, a bar with a diameter of 30 mm or more and 100 mm or less may be used.

In addition, in order to improve the reliability of the final product, before the casting step, a degassing treatment or a filtering treatment may be appropriately performed on the aluminum alloy molten metal.

Since the aluminum alloy ingot having the above configuration according to the present embodiment contains Cu and Mg within the above ranges, the tensile strength is improved. In addition, since it contains Si, Mn, Fe, and Cr within the above ranges, the tensile strength is improved because fine granular crystals containing an intermetallic compound such as $\alpha$-$Al_{15}$(Fe, Mn, (Cr))$_3Si_2$ are precipitated according to the heat treatment. That is, when the aluminum alloy ingot of the present embodiment is heated, the peak height of the peak $\alpha1$ corresponding to an interplanar spacing of 2.154 Å in $\alpha$-$Al_{15}$(Fe, Mn, (Cr))$_3Si_2/\sigma_{bkg}$ shows a high value as 15 or more.

In addition, in the aluminum alloy ingot of the present embodiment, according to the heat treatment, when the peak height of the diffraction peak (peak $\alpha2$) corresponding to an interplanar spacing of 2.094 Å in $\alpha$-$Al_{15}$(Fe, Mn, (Cr))$_3Si_2/\sigma_{bkg}$ shows a high value as 15 or more, the tensile strength is further improved because fine granular crystals containing an intermetallic compound such as $\alpha$-$Al_{15}$(Fe, Mn, (Cr))$_3Si_2$ are more reliably generated.

[Aluminum Alloy Material]

An aluminum alloy material of the present embodiment includes a Cu content in a range of 0.3 mass % or more and 1.0 mass % or less, a Mg content in a range of 0.6 mass % or more and 1.2 mass % or less, a Si content in a range of 0.9 mass % or more and 1.4 mass % or less, a Mn content in a range of 0.4 mass % or more and 0.6 mass % or less, an Fe content in a range of 0.1 mass % or more and 0.7 mass % or less, a Cr content in a range of 0.09 mass % or more and 0.25 mass % or less, and a Ti content in a range of 0.012 mass % or more and 0.035 mass % or less, with the remainder being made up of Al and unavoidable impurities. Here, in addition to the above components, the aluminum alloy material may further have a B content in a range of 0.001 mass % or more and 0.03 mass % or less. The contents of these metals are the same as those in the above aluminum alloy ingot.

In the aluminum alloy material of the present embodiment, in the X-ray diffraction pattern measured using Cu-K$\alpha$ rays, a peak height of the diffraction peak (peak $\alpha1$) observed in a diffraction angle 2θ range of 41.6° or more and 42.0° or less corresponding to an interplanar spacing of 2.154 Å in $\alpha$-$Al_{15}$(Fe, Mn, (Cr))$_3Si_2$ is 15 times or more the standard deviation $\sigma_{bkg}$ of the background X-ray intensity in a range of the full width at half maximum of the diffraction peak. That is, the ratio (peak height/$\sigma_{bkg}$) of the peak height to the standard deviation $\sigma_{bkg}$ of the background X-ray intensity in a range of the full width at half maximum of the peak $\alpha1$ is 15 or more. In addition, the ratio (peak height/FWHM) of the peak height to the full width at half maximum of the peak $\alpha1$ is 5,500 or more. Here, the upper limit of the peak height of the peak $\alpha1$/FWHM is not particularly limited, and is, for example, 20,000.

In the aluminum alloy material of the present embodiment, fine granular crystals containing $\alpha$-$Al_{15}$(Fe, Mn, (Cr))$_3Si_2$ are precipitated in an amount such that the peak height of the peak $\alpha1/\sigma_{bkg}$ is 15 or more, and the peak height of the peak $\alpha1$/FWHM is 5,500 or more, and thus the tensile strength is improved.

In addition, in the aluminum alloy material of the present embodiment, the peak height of the diffraction peak (peak $\alpha2$) observed in a diffraction angle 2θ range of 43.0° or more and 43.4° or less corresponding to an interplanar spacing of 2.094 Å in $\alpha$-$Al_{15}$(Fe, Mn, (Cr))$_3Si_2$ with respect to the peak B may be 20 times or more the standard deviation $\sigma_{bkg}$ of the background X-ray intensity in a range of the full width at half maximum of the diffraction peak. That is, the ratio (peak height/$\sigma_{bkg}$) of the peak height to the standard deviation $\sigma_{bkg}$ of the background X-ray intensity in a range of the full width at half maximum of the peak $\alpha2$ may be 20 or more. In addition, the ratio (peak height/FWHM) of the peak height to the full width at half maximum of the peak $\alpha2$ may be 5,500 or more. In this case, since fine granular crystals containing $\alpha$-$Al_{15}$(Fe, Mn, (Cr))$_3Si_2$ are more reliably generated, the tensile strength is further improved. Here, the upper limit of the peak height of the peak $\alpha2$/FWHM is not particularly limited, and is, for example, 20,000.

[Method for Manufacturing Aluminum Alloy Material]

Next, a method for manufacturing an aluminum alloy material of the present embodiment will be described. The method for manufacturing an aluminum alloy material of the present embodiment is a method for manufacturing the above aluminum alloy material.

In the method for manufacturing an aluminum alloy material of the present embodiment, using the above aluminum alloy ingot as a starting raw material, the aluminum alloy ingot is heated at 400° C. for 1 hour or longer. The method for manufacturing an aluminum alloy material of the present embodiment may include a homogenizing treatment step, a solution treatment step, and an artificial aging treatment step. In addition, the method may include a hot processing step. The hot processing step may be performed between the homogenizing treatment step and the solution treatment step.

The homogenizing treatment step is a step in which an aluminum alloy ingot is heated to eliminate segregation of additive elements that occur during casting and to homogenize the composition. The heat temperature in the homogenizing treatment is, for example, 400° C. or higher, preferably 450° C. or higher, which is effective in preventing precipitation of crystals containing intermetallic compounds such as $\alpha$-$Al_{15}$(Fe, Mn, (Cr))$_3Si_2$ in a size that contributes to strength improvement and recrystallization as coarse particles. In addition, the heat temperature in the homogenizing treatment is, for example, 560° C. or lower, in order to prevent solid-phase melting of the precipitated particles. In addition, when the heating time is too short, since the intermetallic compound coarsely precipitates, the heating time in the homogenizing treatment is, for example, in a range of 2 hours or longer and 10 hours or shorter.

The solution treatment step is a step in which an aluminum alloy ingot is heated and then rapidly cooled, and thus additive elements in the ingot are re-solid-solutionized in the aluminum alloy, and atomic vacancies are frozen. The heat temperature in the solution treatment is, for example, in a range of 520° C. or higher and 570° C. or lower, and the heating time is, for example, in a range of 0.5 hours or longer and 4 hours or shorter. Examples of rapid cooling of the aluminum alloy ingot after heating include water cooling, mist cooling, and fan cooling.

The artificial aging treatment step is a step in which an aluminum alloy is tempered at a low temperature. According to this artificial aging treatment, clusters containing Mg, Si and Cu in the aluminum alloy are generated, and transition to fine precipitates including a G. P. zone, a β" phase and a Q phase. The heat temperature in the artificial aging treatment is, for example, in a range of 170° C. or higher and 200° C. or lower, and the heating time is, for example, in a range of 2 hours or longer and 12 hours or shorter.

The hot processing step is a step in which an aluminum alloy ingot is processed into a predetermined shape while heating. The processing temperature may be, for example, the same as the heat temperature in the homogenizing treatment step. For hot processing, processing methods such as forging, rolling, and extrusion can be used.

In the method for manufacturing an aluminum alloy material of the present embodiment, since the aluminum alloy ingot is heated at 400° C. or higher for 1 hour or longer, fine granular crystals containing an intermetallic compound such as $\alpha$-$Al_{15}(Fe, Mn, (Cr))_3Si_2$ are likely to be generated. Therefore, according to the method for manufacturing an aluminum alloy material of the present embodiment, fine granular crystals containing an intermetallic compound such as $\alpha$-$Al_{15}(Fe, Mn, (Cr))_3Si_2$ are precipitated, and an aluminum alloy material with improved tensile strength can be manufactured.

While the embodiments of the present invention have been described above, these embodiments are only examples, and are not intended to limit the scope of the invention. These embodiments can be implemented in various other forms, and various omissions, substitutions and changes can be made without departing from the sprit and scope of the invention. These embodiments and modifications thereof are included in the spirit and scope of the invention and fall within the inventions described in the appended claims and equivalents thereof.

EXAMPLES

The present invention will be described in more detail with reference to example.

Example 1

An aluminum alloy 1 having an alloy composition shown in the following Table 1 was prepared. In addition, as a casting apparatus, the horizontal continuous casting apparatus 10 shown in FIG. 1 was prepared. The mold 12 of the horizontal continuous casting apparatus 10 was a mold made of industrial pure aluminum, and the thickness of the cooling wall part 27 was 1.3 mm. In this case, the value of the heat flux from the molten metal in the cooling wall part to the mold was $10.4\times10^5$ $W\cdot s^{-1}\cdot m^{-2}$.

TABLE 1

| | Element (mass %) | | | | | | | | |
|---|---|---|---|---|---|---|---|---|---|
| | Cu | Mg | Si | Mn | Fe | Cr | Ti | B | Al |
| Aluminum alloy 1 | 0.41 | 0.84 | 1.1 | 0.51 | 0.24 | 0.16 | 0.020 | 0.0120 | remainder |

The aluminum alloy 1 was heated to form an aluminum alloy molten metal. Next, the obtained aluminum alloy molten metal was supplied to the horizontal continuous casting apparatus 10, and cast under conditions of a casting speed of 400 mm/min by a horizontal continuous casting method, and an elongated rod-like aluminum alloy ingot having a circular cross section with a diameter of 49 mm was produced. Cooling conditions for casting were: the minimum cooling rate was 60° C./sec, the maximum cooling rate was 115° C./sec, and the difference between the maximum cooling rate and the minimum cooling rate was 55° C./sec, on the entire cross section perpendicular to the casting direction. The chemical composition of the obtained aluminum alloy ingot was measured by solid state emission spectroscopy. As a result, the chemical composition of the aluminum ingot was the same as the chemical composition of the aluminum alloy 1. Here, the maximum cooling rate and the minimum cooling rate were measured by observing dendrite arm forms in a cross section perpendicular to the casting direction of the obtained aluminum alloy ingot under an optical microscope and measuring the secondary dendrite arm spacing.

Comparative Example 1

An aluminum alloy ingot was produced in the same manner as in Example 1 except that the mold 12 of the horizontal continuous casting apparatus 10 was a mold made of porous graphite, and the thickness of the cooling wall part 27 was 3.5 mm. The value of the heat flux from the molten metal in the cooling wall part to the mold was $1.57\times10^5$ $W\cdot s^{-1}\cdot m^{-2}$. Cooling conditions for casting were: the minimum cooling rate was 18° C./sec, the maximum cooling rate was 200° C./sec, and the difference between the maximum cooling rate and the minimum cooling rate was 182° C./sec, on the entire cross section perpendicular to the casting direction.

[Evaluation of Aluminum Alloy Ingot]

(X-Ray Diffraction Pattern)

The X-ray diffraction patterns of the aluminum alloy ingots obtained in Example 1 and Comparative Example 1 were measured as follows. Here, the X-ray diffraction patterns of the aluminum alloy ingot obtained in Example 1 were measured before the heat treatment immediately after manufacturing and after the heat treatment after heating at 450° C. for 1 hour.

(Method for Measuring X-Ray Diffraction Pattern)

The aluminum alloy ingot was cut so that the cross section perpendicular to the casting direction of the aluminum alloy ingot became the measurement surface to obtain a disc component with a diameter of 49 mm and a thickness of 10 mm. The disc surface of the obtained disc component was polished with emery paper and then polished with a diamond paste. Then, finally, the disc surface of the disc component was buff-polished using a colloidal silica suspension to perform mirror finishing, and thereby a sample for X-ray diffraction pattern measurement was obtained.

As an X-ray diffraction pattern measurement device, an X-ray diffraction device (SmartLab, commercially available from Rigaku Corporation) was used. Cu-Kα rays were generated using Cu-Kα as an X-ray source under conditions of a tube voltage of 40 kV and a tube current of 30 mA, 2θ-θ scanning was performed using a focusing optical system, and the X-ray diffraction pattern of the center of the sample was measured. Regarding measurement conditions, the scanning speed was 0.5°/min, the scanning step was 0.1°, and the KB filter was arranged on the incident side.

From the obtained X-ray diffraction pattern, a diffraction peak (peak α1) observed in a diffraction angle 2θ range of 41.6° or more and 42.0° or less, and a diffraction peak (peak α2) observed in a diffraction angle 2θ range of 43.0° or more and 43.4° or less were extracted. For the obtained peak α1 and peak α2, the peak height, the full width at half maximum (FWHM), the standard deviation ($\sigma_{bkg}$) of background X-ray intensities measured in a range of the full width at half maximum of the diffraction peaks, the integral width and the integrated intensity were calculated. Analysis software (PDXL II, commercially available from Rigaku Corporation) was used to extract the peak α1 and the peak α2 and to calculate the peak height, FWHM, $\sigma_{bkg}$, the integral width and the integrated intensity. The peak α1 and the peak α2 were extracted using a second-order differential method. The peak height, FWHM, $\sigma_{bkg}$, the integral width and the integrated intensity were calculated by fitting a split pseudo-Voigt function to each peak. Here, when the peak height was $\sigma_{bkg}$ or less, the peak was determined to be not detected (ND).

(Evaluation Results)

Figure 4:
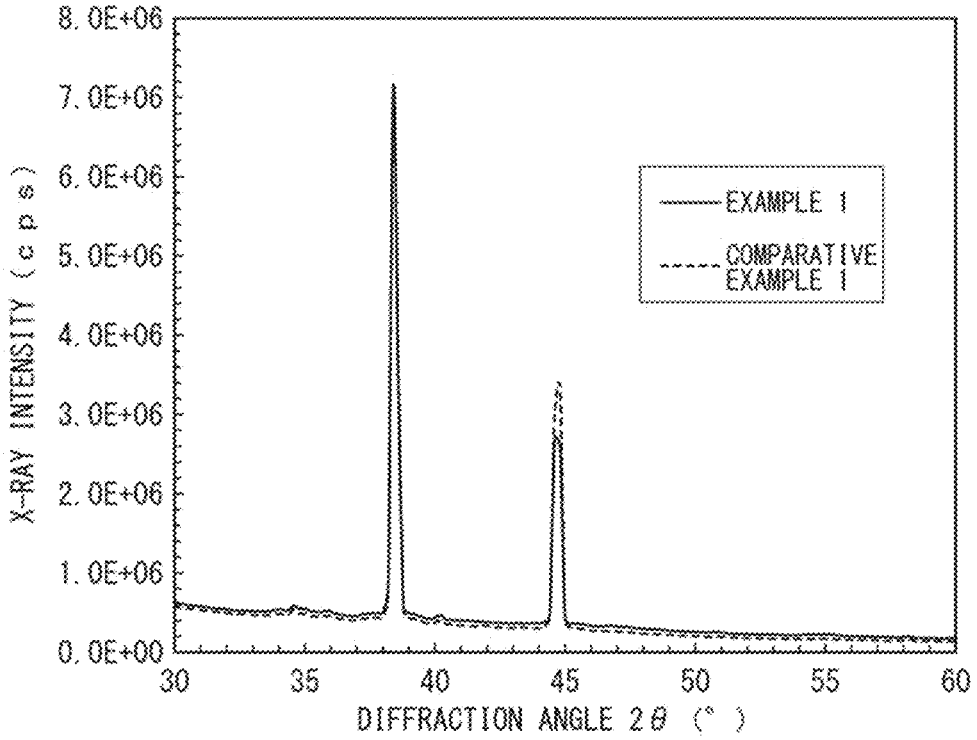
FIG. 4 shows X-ray diffraction patterns of aluminum alloy ingots obtained in Example 1 and Comparative Example 1.
Figure 5:
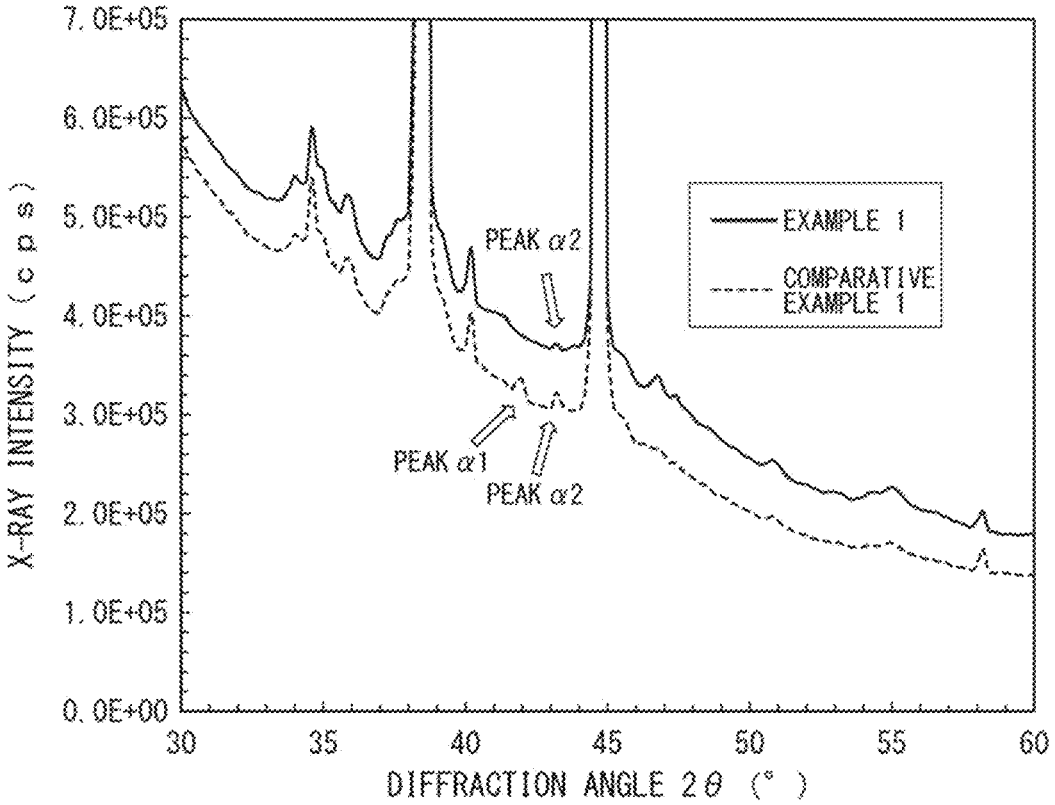
FIG. 5 is an enlarged view of the X-ray diffraction patterns shown in FIG. 4.

FIG. 4 shows X-ray diffraction patterns of the aluminum alloy ingots obtained in Example 1 and Comparative Example 1, and FIG. 5 shows an enlarged view thereof.

As shown in FIG. 4 and FIG. 5, a diffraction peak (peak α1) corresponding to an interplanar spacing of 2.154 Å in α-$Al_{15}$(Fe, Mn, (Cr))$_3Si_2$ in a diffraction angle 2θ range of 41.6° or more and 42.0° or less was detected in the X-ray diffraction pattern of the aluminum alloy ingot obtained in Comparative Example 1 but was not detected in the X-ray diffraction pattern of the aluminum alloy ingot obtained in Example 1. On the other hand, a diffraction peak (peak α2) corresponding to an interplanar spacing of 2.093 Å in α-$Al_{15}$(Fe, Mn, (Cr))$_3Si_2$ in a diffraction angle 2θ range of 43.0° or more and 43.4° or less was detected in both the X-ray diffraction patterns of the aluminum alloy ingot obtained in Example 1 and the aluminum alloy ingot obtained in Comparative Example 1, but the peak intensity was lower in Example 1. Here, the diffraction peak in a diffraction angle 2θ range of 38.4° or more and 38.8° or less was a peak corresponding to an interplanar spacing 2.338 Å in aluminum.

Figure 6:
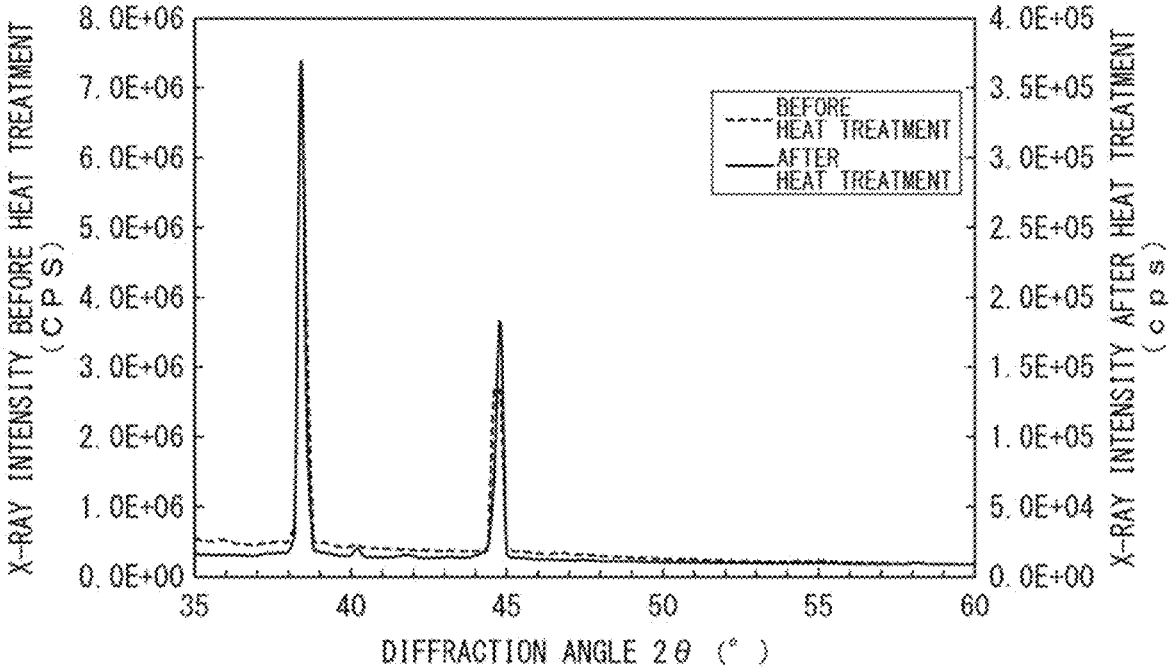
FIG. 6 shows X-ray diffraction patterns before a heat treatment and after a heat treatment of the aluminum alloy ingot obtained in Example 1.
Figure 7:
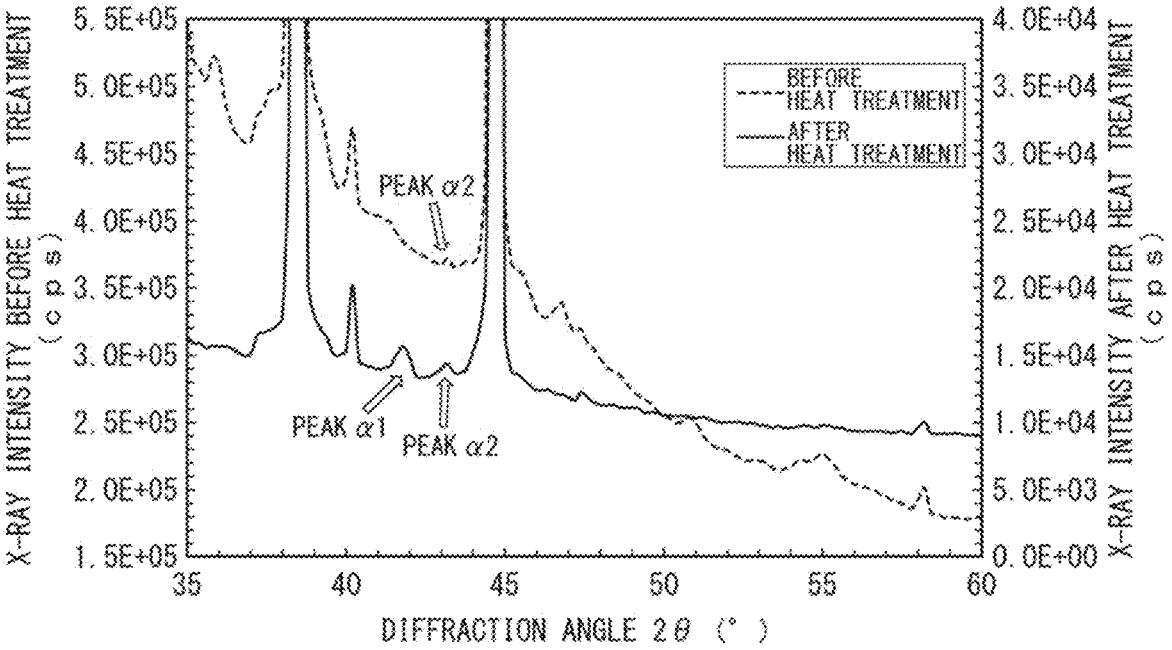
FIG. 7 is an enlarged view of the X-ray diffraction patterns shown in FIG. 6.

FIG. 6 shows X-ray diffraction patterns of the aluminum alloy ingot obtained in Example 1 before the heat treatment and after the heat treatment, and FIG. 7 shows an enlarged view thereof. The following Table 2 shows the diffraction angle 2θ of the peak α1 and the peak α2, the peak height, $\sigma_{bkg}$, and the ratio of the peak height to $\sigma_{bkg}$ (peak height/$\sigma_{bkg}$).

TABLE 2

| | | | Diffraction angle 2θ (deg) | Peak height (cps) | $\sigma_{bkg}$ (cps) | Peak height/$\sigma_{bkg}$ |
|---|---|---|---|---|---|---|
| Example 1 | before heat treatment | peak α1 | 41.82 | ND | 69 | — |
| | | peak α2 | 43.23 | 171 | 160 | 1.07 |
| | after heat treatment | peak α1 | 41.88 | 1034 | 43 | 24 |
| | | peak α2 | 43.15 | 474 | 12 | 39 |

Based on the results of FIG. 6, FIG. 7 and Table 2, it was confirmed that, in the aluminum alloy ingot obtained in Example 1, the peak height/$\sigma_{bkg}$ before the heat treatment and after the heat treatment was within the scope of the present invention. This is because α-$Al_{15}$(Fe, Mn, (Cr))$_3Si_2$ was not precipitated during casting, and α-Al $_{15}$(Fe, Mn, (Cr))$_3Si_2$ was precipitated by the subsequent heat treatment. The reason why α-$Al_{15}$(Fe, Mn, (Cr))$_3Si_2$ was not precipitated during casting was that the minimum cooling rate during casting was fast.

[Production of Aluminum Alloy Material]

The aluminum ingots obtained in Example 1 and Comparative Example 1 were subjected to a homogenizing treatment, a solution treatment and an artificial aging treatment in that order to produce aluminum alloy materials. The heating rate, the holding temperature, the holding time and the subsequent cooling method in the homogenizing treatment, the solution treatment and the artificial aging treatment are shown in the following Table 3.

TABLE 3

| Step | Heating rate | Holding temperature | Holding time | Cooling method |
|---|---|---|---|---|
| Homogenizing treatment | 1° C./min | 470° C. | 7 h | air cooling |
| Solution treatment | 10° C./min | 545° C. | 3 h | hot water quenching at 60° C. |
| Artificial aging treatment | 2° C./min | 180° C. | 5 h | air cooling |

[Evaluation of Aluminum Alloy Material]

(X-Ray Diffraction Pattern)

The X-ray diffraction pattern of the obtained aluminum alloy material was measured. From the obtained X-ray diffraction pattern, a diffraction peak (peak α1) observed in a diffraction angle 2θ range of 41.6° or more and 42.0° or less and a diffraction peak (peak α2) observed in a diffraction angle 2θ range of 43.0° or more and 43.4° or less were extracted, and the diffraction angle 2θ, the peak height, FWHM, $\sigma_{bkg}$, the integral width and the integrated intensity were calculated. In addition, the ratio (peak height/$\sigma_{bkg}$) of the peak height to $\sigma_{bkg}$ and the ratio (peak height/FWHW) of the peak height to FWHW were calculated. The results are shown in the following Table 4 together with the results of the aluminum alloy cast material before the heat treatment.

(Tensile Properties)

Tensile properties of the obtained aluminum alloy material were measured by the following method. The results are shown in the following Table 5.

The tensile properties were evaluated according to ASTM-E8 standards. That is, a test piece with a gauge length of 25.4 mm and a parallel section diameter of 6.4 mm was collected from the aluminum alloy material. The obtained test piece was subjected to a tensile test at a rate of 2 mm/min at room temperature (25° C.), and the tensile strength, the 0.2% proof stress and the elongation at break were measured.

TABLE 4

| | | | Diffraction angle 2θ (deg) | Peak height (CPS) | FWHM (deg) | $\sigma_{bkg}$ (cps) | Integral width (deg) | Integrated intensity (cps · deg) | Peak height/ $\sigma_{bkg}$ | Peak height/ FWHM |
|---|---|---|---|---|---|---|---|---|---|---|
| Example 1 | aluminum ingot | peak α1 | 41.82 | ND | 0.25 | 69 | ND | ND | — | — |
| | | peak α2 | 43.23 | 171 | 0.83 | 160 | 0.879 | 150 | 1.07 | 206 |
| | aluminum alloy material | peak α1 | 41.82 | 1040 | 0.18 | 69 | 0.243 | 253 | 15.07 | 5778 |
| | | peak α2 | 43.12 | 1408 | 0.15 | 28 | 0.16 | 225 | 50.29 | 9387 |
| Comparative Example 1 | aluminum ingot | peak α1 | 41.94 | 972 | 0.192 | 67 | 0.34 | 330 | 14.51 | 5063 |
| | | peak α2 | 43.15 | 788 | 0.207 | 86 | 0.36 | 287 | 9.16 | 3807 |
| | aluminum alloy material | peak α1 | 41.73 | 236 | 0.159 | 35 | 0.17 | 41 | 6.74 | 1484 |
| | | peak α2 | 43.09 | 338 | 0.101 | 19 | 0.11 | 37 | 17.79 | 3347 |

TABLE 5

| | Tensile properties | | |
|---|---|---|---|
| | Tensile strength (MPa) | 0.2% proof stress (MPa) | Elongation at break (—) |
| Example 1 | 400 | 356 | 14% |
| Comparative Example 1 | 384 | 340 | 12% |

Based on the results of Table 4 and Table 5, it can be understood that the aluminum alloy material produced using the aluminum ingot obtained in Example 1 exhibited higher values of tensile properties such as the tensile strength, 0.2% proof stress and elongation at break than the aluminum alloy material produced using the aluminum ingot obtained in Comparative Example 1. This is because the content of $\alpha$-$Al_{15}$ (Fe, Mn, (Cr))$_3Si_2$ in the metal structure increased as can be seen from the fact that the peak height/$\sigma_{bkg}$ and the peak height/FWHW became larger when the aluminum alloy ingot obtained in Example 1 was subjected to a homogenizing treatment, a solution treatment and an artificial aging treatment.

INDUSTRIAL APPLICABILITY

According to the aluminum alloy ingot of the present invention, it is possible to provide the aluminum alloy ingot that can be advantageously used as a raw material for aluminum alloy materials (products) with improved tensile strength. Therefore, the present invention has industrial applicability.

REFERENCE SIGNS LIST

10 Horizontal continuous casting apparatus
11 Molten metal receiving part (tundish)
11*a* Molten metal inflow part
11*b* Molten metal holding part
11*c* Outflow part
12 Mold
12*a* One end side
12*b* Other end side
13 Refractory plate (insulation member)
13*a* Pouring path
21 Hollow part
21*a* Inner circumferential surface
22 Fluid supply pipe
22*a* Lubricant supply port
23 Cooling apparatus
24 Cooling water cavity
24*a* Inner bottom surface
25 Cooling water injection path
25*a* Shower opening
26 Cooling water supply pipe
27 Cooling wall part
B Aluminum alloy rod
M Alloy molten metal
W Cooling water

The invention claimed is:

1. An aluminum alloy ingot including a Cu content in a range of 0.3 mass % or more and 1.0 mass % or less, a Mg content in a range of 0.6 mass % or more and 1.2 mass % or less, a Si content in a range of 0.9 mass % or more and 1.4 mass % or less, a Mn content in a range of 0.4 mass % or more and 0.6 mass % or less, an Fe content in a range of 0.1 mass % or more and 0.7 mass % or less, a Cr content in a range of 0.09 mass % or more and 0.25 mass % or less, and a Ti content in a range of 0.012 mass % or more and 0.035 mass % or less, with the remainder being made up of Al and unavoidable impurities, wherein, in an X-ray diffraction pattern measured using Cu-Kα rays, a peak height of a diffraction peak observed in a diffraction angle 20 range of 41.6° or more and 42.0° or less is a value smaller than 6 times a standard deviation of a background X-ray intensity in a range of a full width at half maximum of the diffraction peak, and wherein, in a heat-treated product after heating at 450° C. for 1 hour, in an X-ray diffraction pattern measured using Cu-Kα rays, a peak height of the diffraction peak observed in a diffraction angle 20 range of 41.6° or more and 42.0° or less is 15 times or more a standard deviation of the background X-ray intensity in the range of a full width at half maximum of the diffraction peak.

2. The aluminum alloy ingot according to claim 1, further including a B content in a range of 0.001 mass % or more and 0.03 mass % or less.

3. The aluminum alloy ingot according to claim 1, wherein, in an X-ray diffraction pattern measured using Cu-Kα rays, a peak height of a diffraction peak observed in a diffraction angle 20 range of 43.0° or more and 43.4° or less is a value smaller than 6 times the standard deviation of the background X-ray intensity in the range of a full width at half maximum of the diffraction peak, and wherein, in a heat-treated product after heating at 450° C. for 1 hour, in an X-ray diffraction pattern measured using Cu-Kα rays, a peak height of the diffraction peak observed in a diffraction angle 2θ range of 41.6° or more and 42.0° or less is 20 times or more the standard deviation of the background X-ray intensity in the range of the full width at half maximum of the diffraction peak.

4. The aluminum alloy ingot according to claim 3, further including a B content in a range of 0.001 mass % or more and 0.03 mass % or less.

5. An aluminum alloy material including a Cu content in a range of 0.3 mass % or more and 1.0 mass % or less, a Mg content in a range of 0.6 mass % or more and 1.2 mass % or less, a Si content in a range of 0.9 mass % or more and 1.4 mass % or less, a Mn content in a range of 0.4 mass % or more and 0.6 mass % or less, an Fe content in a range of 0.1 mass % or more and 0.7 mass % or less, a Cr content in a range of 0.09 mass % or more and 0.25 mass % or less, and a Ti content in a range of 0.012 mass % or more and 0.035 mass % or less, with the remainder being made up of Al and unavoidable impurities, wherein, in an X-ray diffraction pattern measured using Cu-Kα rays, a peak height of a diffraction peak observed in a diffraction angle 2θ range of 41.6° or more and 42.0° or less is 15 times or more a standard deviation of a background X-ray intensity in a range of a full width at half maximum of the diffraction peak, and a ratio of the peak height to the full width at half maximum of the diffraction peak is 5,500 or more.

6. The aluminum alloy material according to claim 5, wherein, in an X-ray diffraction pattern measured using Cu-Kα rays, a peak height of a diffraction peak observed in a diffraction angle 2θ range of 41.6° or more and 42.0° or less is 20 times or more a standard deviation of a background X-ray intensity in a range of a full width at half maximum of the diffraction peak, and a ratio of the peak height to the full width at half maximum of the diffraction peak is 5,500 or more.

7. A method for manufacturing the aluminum alloy material according to claim 6, comprising a step of heating an aluminum alloy ingot at 400° C. or higher for 1 hour or longer, wherein the aluminum alloy ingot includes a Cu content in a range of 0.3 mass % or more and 1.0 mass % or less, a Mg content in a range of 0.6 mass % or more and 1.2 mass % or less, a Si content in a range of 0.9 mass % or more and 1.4 mass % or less, a Mn content in a range of 0.4 mass % or more and 0.6 mass % or less, an Fe content in a range of 0.1 mass % or more and 0.7 mass % or less, a Cr content in a range of 0.09 mass % or more and 0.25 mass % or less, and a Ti content in a range of 0.012 mass % or more and 0.035 mass % or less, with the remainder being made up of Al and unavoidable impurities, wherein, in an X-ray diffraction pattern measured using Cu-Kα rays, a peak height of a diffraction peak observed in a diffraction angle 2θ range of 41.6° or more and 42.0° or less is a value smaller than 6 times a standard deviation of a background X-ray intensity in a range of a full width at half maximum of the diffraction peak, and wherein, in a heat-treated product after heating at 450° C. for 1 hour, in an X-ray diffraction pattern measured using Cu-Kα rays, a peak height of the diffraction peak observed in a diffraction angle 2θ range of 41.6° or more and 42.0° or less is 15 times or more a standard deviation of the background X-ray intensity in the range of a full width at half maximum of the diffraction peak.

8. A method for manufacturing the aluminum alloy material according to claim 6, comprising a step of heating the aluminum alloy ingot at 400° C. or higher for 1 hour or longer, wherein the aluminum alloy ingot including a Cu content in a range of 0.3 mass % or more and 1.0 mass % or less, a Mg content in a range of 0.6 mass % or more and 1.2 mass % or less, a Si content in a range of 0.9 mass % or more and 1.4 mass % or less, a Mn content in a range of 0.4 mass % or more and 0.6 mass % or less, an Fe content in a range of 0.1 mass % or more and 0.7 mass % or less, a Cr content in a range of 0.09 mass % or more and 0.25 mass % or less, and a Ti content in a range of 0.012 mass % or more and 0.035 mass % or less, with the remainder being made up of Al and unavoidable impurities, wherein, in an X-ray diffraction pattern measured using Cu-Kα rays, a peak height of a diffraction peak observed in a diffraction angle 2θ range of 43.0° or more and 43.4° or less is a value smaller than 6 times the standard deviation of the background X-ray intensity in the range of a full width at half maximum of the diffraction peak, and wherein, in a heat-treated product after heating at 450° C. for 1 hour, in an X-ray diffraction pattern measured using Cu-Kα rays, a peak height of the diffraction peak observed in a diffraction angle 2θ range of 41.6° or more and 42.0° or less is 20 times or more the standard deviation of the background X-ray intensity in the range of the full width at half maximum of the diffraction peak.

9. A method for manufacturing the aluminum alloy material according to claim 6, comprising a step of heating the aluminum alloy ingot at 400° C. or higher for 1 hour or longer, wherein the aluminum alloy ingot including a Cu content in a range of 0.3 mass % or more and 1.0 mass % or less, a Mg content in a range of 0.6 mass % or more and 1.2 mass % or less, a Si content in a range of 0.9 mass % or more and 1.4 mass % or less, a Mn content in a range of 0.4 mass % or more and 0.6 mass % or less, an Fe content in a range of 0.1 mass % or more and 0.7 mass % or less, a Cr content in a range of 0.09 mass % or more and 0.25 mass % or less, a Ti content in a range of 0.012 mass % or more and 0.035 mass % or less, and a B content in a range of 0.001 mass % or more and 0.03 mass % or less, with the remainder being made up of Al and unavoidable impurities, wherein, in an X-ray diffraction pattern measured using Cu-Kα rays, a peak height of a diffraction peak observed in a diffraction angle 2θ range of 41.6° or more and 42.0° or less is a value smaller than 6 times a standard deviation of a background X-ray intensity in a range of a full width at half maximum of the diffraction peak, and wherein, in a heat-treated product after heating at 450° C. for 1 hour, in an X-ray diffraction pattern measured using Cu-Kα rays, a peak height of the diffraction peak observed in a diffraction angle 2θ range of 41.6° or more and 42.0° or less is 15 times or more a standard deviation of the background X-ray intensity in the range of a full width at half maximum of the diffraction peak.

10. A method for manufacturing the aluminum alloy material according to claim 6, comprising a step of heating the aluminum alloy ingot at 400° C. or higher for 1 hour or longer, wherein the aluminum alloy ingot including a Cu content in a range of 0.3 mass % or more and 1.0 mass % or less, a Mg content in a range of 0.6 mass % or more and 1.2 mass % or less, a Si content in a range of 0.9 mass % or more and 1.4 mass % or less, a Mn content in a range of 0.4 mass % or more and 0.6 mass % or less, an Fe content in a range of 0.1 mass % or more and 0.7 mass % or less, a Cr content in a range of 0.09 mass % or more and 0.25 mass % or less, a Ti content in a range of 0.012 mass % or more and 0.035 mass % or less, and a B content in a range of 0.001 mass % or more and 0.03 mass % or less, with the remainder being made up of Al and unavoidable impurities, wherein, in an X-ray diffraction pattern measured using Cu-Kα rays, a peak height of a diffraction peak observed in a diffraction angle 2θ range of 43.0° or more and 43.4° or less is a value smaller than 6 times the standard deviation of the background X-ray intensity in the range of a full width at half maximum of the diffraction peak, and wherein, in a heat-treated product after heating at 450° C. for 1 hour, in an X-ray diffraction pattern measured using Cu-Kα rays, a peak height of the diffraction peak observed in a diffraction angle 2θ range of 41.6° or more and 42.0° or less is 20 times or more the standard deviation of the background X-ray intensity in the range of the full width at half maximum of the diffraction peak.

11. A method for manufacturing the aluminum alloy material according to claim 6, comprising a step of heating the aluminum alloy ingot at 400° C. or higher for 1 hour or longer, wherein the aluminum alloy ingot including a Cu content in a range of 0.3 mass % or more and 1.0 mass % or less, a Mg content in a range of 0.6 mass % or more and 1.2 mass % or less, a Si content in a range of 0.9 mass % or more and 1.4 mass % or less, a Mn content in a range of 0.4 mass % or more and 0.6 mass % or less, an Fe content in a range of 0.1 mass % or more and 0.7 mass % or less, a Cr content in a range of 0.09 mass % or more and 0.25 mass % or less, and a Ti content in a range of 0.012 mass % or more and 0.035 mass % or less, with the remainder being made up of Al and unavoidable impurities, wherein, in an X-ray diffraction pattern measured using Cu-Kα rays, a peak height of a diffraction peak observed in a diffraction angle 2θ range of 41.6° or more and 42.0° or less is a value smaller than 6 times a standard deviation of a background X-ray intensity in a range of a full width at half maximum of the diffraction peak, and wherein, in a heat-treated product after heating at 450° C. for 1 hour, in an X-ray diffraction pattern measured using Cu-Kα rays, a peak height of the diffraction peak observed in a diffraction angle 2θ range of 41.6° or more and 42.0° or less is 15 times or more a standard deviation of the background X-ray intensity in the range of a full width at half maximum of the diffraction peak.

12. A method for manufacturing the aluminum alloy material according to claim 6, comprising a step of heating the aluminum alloy ingot at 400° C. or higher for 1 hour or longer, wherein the aluminum alloy ingot including a Cu content in a range of 0.3 mass % or more and 1.0 mass % or less, a Mg content in a range of 0.6 mass % or more and 1.2 mass % or less, a Si content in a range of 0.9 mass % or more and 1.4 mass % or less, a Mn content in a range of 0.4 mass % or more and 0.6 mass % or less, an Fe content in a range of 0.1 mass % or more and 0.7 mass % or less, a Cr content in a range of 0.09 mass % or more and 0.25 mass % or less, and a Ti content in a range of 0.012 mass % or more and 0.035 mass % or less, with the remainder being made up of Al and unavoidable impurities, wherein, in an X-ray diffraction pattern measured using Cu-Kα rays, a peak height of a diffraction peak observed in a diffraction angle 2θ range of 43.0° or more and 43.4° or less is a value smaller than 6 times the standard deviation of the background X-ray intensity in the range of a full width at half maximum of the diffraction peak, and wherein, in a heat-treated product after heating at 450° C. for 1 hour, in an X-ray diffraction pattern measured using Cu-Kα rays, a peak height of the diffraction peak observed in a diffraction angle 2θ range of 41.6° or more and 42.0° or less is 20 times or more the standard deviation of the background X-ray intensity in the range of the full width at half maximum of the diffraction peak.

13. A method for manufacturing the aluminum alloy material according to claim 6, comprising a step of heating the aluminum alloy ingot at 400° C. or higher for 1 hour or longer, wherein the aluminum alloy ingot including a Cu content in a range of 0.3 mass % or more and 1.0 mass % or less, a Mg content in a range of 0.6 mass % or more and 1.2 mass % or less, a Si content in a range of 0.9 mass % or more and 1.4 mass % or less, a Mn content in a range of 0.4 mass % or more and 0.6 mass % or less, an Fe content in a range of 0.1 mass % or more and 0.7 mass % or less, a Cr content in a range of 0.09 mass % or more and 0.25 mass % or less, a Ti content in a range of 0.012 mass % or more and 0.035 mass % or less, and a B content in a range of 0.001 mass % or more and 0.03 mass % or less, with the remainder being made up of Al and unavoidable impurities, wherein, in an X-ray diffraction pattern measured using Cu-Kα rays, a peak height of a diffraction peak observed in a diffraction angle 2θ range of 41.6° or more and 42.0° or less is a value smaller than 6 times a standard deviation of a background X-ray intensity in a range of a full width at half maximum of the diffraction peak, and wherein, in a heat-treated product after heating at 450° C. for 1 hour, in an X-ray diffraction pattern measured using Cu-Kα rays, a peak height of the diffraction peak observed in a diffraction angle 2θ range of 41.6° or more and 42.0° or less is 15 times or more a standard deviation of the background X-ray intensity in the range of a full width at half maximum of the diffraction peak.

14. A method for manufacturing the aluminum alloy material according to claim 6, comprising a step of heating the aluminum alloy ingot at 400° C. or higher for 1 hour or longer, wherein the aluminum alloy ingot including a Cu content in a range of 0.3 mass % or more and 1.0 mass % or less, a Mg content in a range of 0.6 mass % or more and 1.2 mass % or less, a Si content in a range of 0.9 mass % or more and 1.4 mass % or less, a Mn content in a range of 0.4 mass % or more and 0.6 mass % or less, an Fe content in a range of 0.1 mass % or more and 0.7 mass % or less, a Cr content in a range of 0.09 mass % or more and 0.25 mass % or less, a Ti content in a range of 0.012 mass % or more and 0.035 mass % or less, and a B content in a range of 0.001 mass % or more and 0.03 mass % or less, with the remainder being made up of Al and unavoidable impurities, wherein, in an X-ray diffraction pattern measured using Cu-Kα rays, a peak height of a diffraction peak observed in a diffraction angle 2θ range of 43.0° or more and 43.4° or less is a value smaller than 6 times the standard deviation of the background X-ray intensity in the range of a full width at half maximum of the diffraction peak, and wherein, in a heat-treated product after heating at 450° C. for 1 hour, in an X-ray diffraction pattern measured using Cu-Kα rays, a peak height of the diffraction peak observed in a diffraction angle 2θ range of 41.6° or more and 42.0° or less is 20 times or more the standard deviation of the background X-ray intensity in the range of the full width at half maximum of the diffraction peak.

* * * * *